US009994495B2

(12) United States Patent
Reimer et al.

(10) Patent No.: US 9,994,495 B2
(45) **Date of Patent: *Jun. 12, 2018**

(54) COMBUSTIBLE AEROSOL COMPOSITION

(71) Applicant: Goodrich Corporation, Charlotte, NC (US)

(72) Inventors: Karl G. Reimer, Fairfeld, CA (US); Jean C. Rodriguez, Vallejo, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/074,349

(22) Filed: Mar. 18, 2016

(65) Prior Publication Data

US 2017/0267600 A1 Sep. 21, 2017

(51) Int. Cl.

| | |
|---|---|
| ***C06B 45/02*** | (2006.01) |
| ***A62C 13/22*** | (2006.01) |
| ***A62D 1/00*** | (2006.01) |
| ***A62D 1/06*** | (2006.01) |
| ***C06B 29/02*** | (2006.01) |
| ***A62C 3/16*** | (2006.01) |
| ***A62C 5/00*** | (2006.01) |
| *D03D 23/00* | (2006.01) |
| *D03D 43/00* | (2006.01) |

(52) U.S. Cl.

CPC ..... *C06B 45/02* (2013.01); *A62C 3/16* (2013.01); *A62C 5/006* (2013.01); *A62C 13/22* (2013.01); *A62D 1/0092* (2013.01); *A62D 1/06* (2013.01); *C06B 29/02* (2013.01)

(58) Field of Classification Search

USPC ..... 149/21, 109.4, 109.6

See application file for complete search history.

(56) References Cited

U.S. PATENT DOCUMENTS

| | | | | |
|---|---|---|---|---|
| 2,275,032 | A | 3/1942 | Greider et al. | |
| 3,468,839 | A | 9/1969 | Millane et al. | |
| 5,240,692 | A | 8/1993 | Morifuji | |
| 5,861,106 | A | 1/1999 | Olander | |
| 7,407,598 | B2 | 8/2008 | Posson et al. | |
| 7,906,034 | B2 | 3/2011 | Posson et al. | |
| 8,182,711 | B2 | 5/2012 | Posson et al. | |
| 9,199,108 | B2 | 12/2015 | Guo et al. | |
| 2005/0129606 | A1 | 6/2005 | Mitsuhashi et al. | |
| 2005/0242319 | A1 | 11/2005 | Posson et al. | |
| 2008/0245537 | A1 | 10/2008 | Posson et al. | |
| 2011/0155943 | A1* | 6/2011 | Posson | A62D 1/06 252/3 |
| 2012/0273714 | A1 | 11/2012 | Guo et al. | |
| 2015/0044469 | A1* | 2/2015 | Lorgouilloux | C01F 5/24 428/402 |
| 2016/0107012 | A1* | 4/2016 | Reimer | A62C 5/006 169/46 |

FOREIGN PATENT DOCUMENTS

| | | | |
|---|---|---|---|
| EP | 2617473 | A1 | 7/2013 |

OTHER PUBLICATIONS

Search Report regarding related EP App. No. 17161644.4; dated Aug. 16, 2017; 9 pgs.

* cited by examiner

*Primary Examiner* — James E McDonough
(74) *Attorney, Agent, or Firm* — Cantor Colburn LLP

(57) ABSTRACT

A combustible aerosol composition is disclosed including an oxidizer including potassium bromate, a fuel including potassium cyanurate, and a hydrated mineral composition including potassium hydromagnesite.

19 Claims, 1 Drawing Sheet

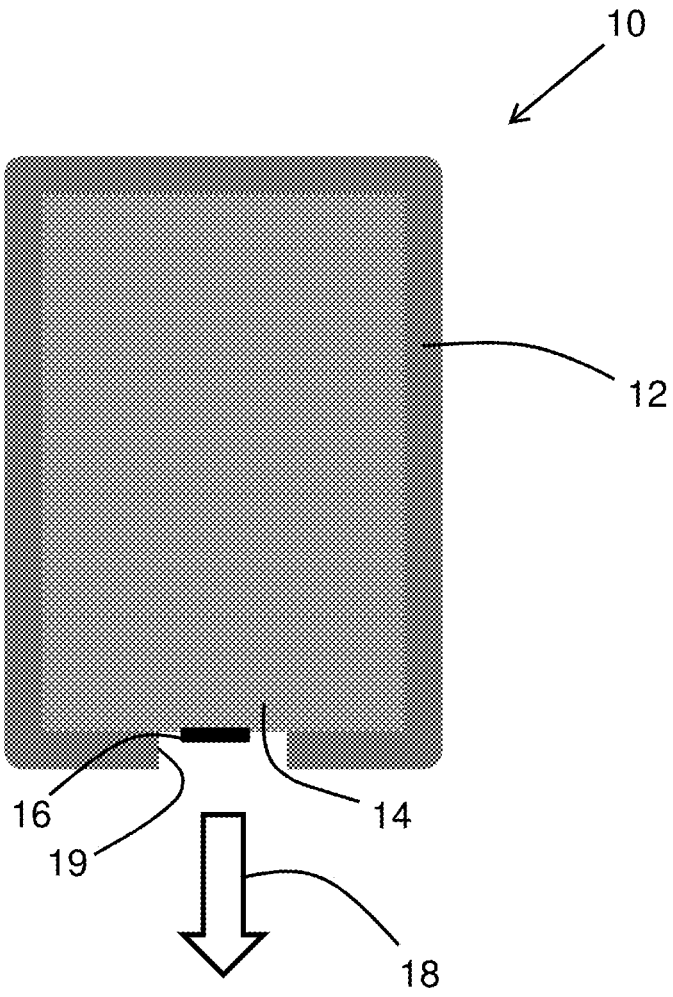
10
12
16
19
14
18

COMBUSTIBLE AEROSOL COMPOSITION

BACKGROUND

This invention relates combustible aerosol compositions, and in particular to combustible aerosol compositions that can be used for applications such as fire suppression.

Flame suppressants can be classified as either active (chemical) or passive (physical) suppressants. Active suppression agents react chemically with and destroy free radicals in the flame. Free radicals are very short-lived species that catalyze flame reactions, and their chemical removal or modification in turn suppresses the flame. Passive suppressants often seek to deprive the combusting fuel from oxygen by physically interfering from its transport to or access to the flame combusting fuel.

One form of active suppressant is a class of materials sold as Halon™, which are composed of brominated or chlorinated fluorocarbon compounds, e.g., bromochlorodifluoromethane ($CF_2BrCl$) and trifluorobromomethane ($CF_3Br$). These and competitive materials using similar chemistry have been used effectively as fire suppression agents for years, typically to protect electrical equipment since there is very little residue to clean up. These fire suppression agents typically interrupt the chemical reaction that takes place when fuels burn and depend on a combination of chemical effectiveness, e.g., quenching of free radicals, and some physical effectiveness, e.g., cooling the combustion flame and dilution of the combustion ingredients. Certain halogen-containing fire suppression agents, however, such as $CF_3Br$, contribute to the destruction of stratospheric ozone. Although the materials are essentially nontoxic, passage through a flame or over hot surfaces can produces toxic fluorine compounds.

To reduce the environmental effects associated with halogenated fluorocarbons, many commercially available fire suppression agents designed today are passive, i.e., physically acting, agents. A passive suppressant does not react chemically with the flame. These fire suppression agents either blanket the burning material to deprive it of oxygen, or they dilute the oxygen in the environment to below the point that can sustain the flame, or they cool the burning surface below its ignition temperature. Examples of physically-acting fire suppression agents include sodium bicarbonate and sand as well as inert gases, e.g., carbon dioxide ($CO_2$), water vapor ($H_2O$), and nitrogen ($N_2$). When applied to a fire, inert gases physically displace oxygen from the combustion region while simultaneously serving as a heat sink to reduce the temperature of the flame. The combination of the two physical actions results in suppression of the fire. Gaseous passive agents cannot be used as total flooding agents in occupied spaces because they must reduce the oxygen content below the amount that will sustain life. This is especially true for carbon dioxide because it also interferes with human respiration in addition to simple localized dilution of oxygen.

Physically-acting fire suppression agents are subject to certain issues and problems that can reduce their effectiveness at fire suppression. They typically a require large quantity of a physically-acting fire suppressant in order to suppress a fire and, consequently, equipment and storage must be large to accommodate the large quantity. Such large equipment is a disadvantage in limited spaces. Another disadvantage of physical suppressants is that they must often be applied directly to a combusting surface, which can inhibit their effectiveness against fires that are concealed or relatively inaccessible.

An alternative to the above suppressant agent systems is the use of a pyrotechnically-generated aerosol flame free radical suppressant. This generation method may provide particles of free radical suppressant materials of such small particle size that their free-fall velocity is less than the velocity of air currents in an enclosed space. As such, the particles stay suspended, and seek out even concealed fires such as those that might be found inside enclosed spaces such as aircraft cargo subcontainers (e.g., an LD-3 container used on commercial aircraft). The smoke-like suspension characteristics of the aerosol provide long "hang times," referring to the length of time a single generator function can continue to suppress recurrent flame. Another benefit of such pyrochemically generated aerosol is that their ozone-depleting potential may approach zero, that their inhalation toxicity may be much lower than that of inert gas, and that no toxic irritant gases may be generated on passage through flame or with hot surfaces.

Unfortunately, existing combustible fire suppressant aerosols also experience a number of issues that can limit their effectiveness. For example, some combustible aerosol compositions have a limited operating temperature range of about 15.5° C. to about 35° C., and can fail to ignite at temperatures outside this range, or a product that ignites at higher temperatures will not ignite at lower temperatures, or a product that ignites at lower temperatures may not ignite or may combust too aggressively at higher temperatures. However, environments in which fire suppression systems are deployed can be subject to a much wider range of temperatures, such as from about −40° C. to about 71° C., thus limiting the effectiveness of combustible aerosol fire suppressants for many applications.

Prior attempts have suggested to cool the aerosol stream through the addition of solid carbonate or dicarboxylic acid salt coolants such as magnesium carbonate or magnesium oxalate in the combustion composition. However, these salts have very high decomposition temperatures, such as magnesium carbonate having a decomposition temperature of greater than 538° C. (1000° F.) and therefore acts only as an inert diluent below that temperature. Other prior attempts have suggested to cool the aerosol stream through the inclusion of hydrated magnesium oxalate or ettringite. However, these compounds release water and moisture at relatively low temperatures and will not allow the flame front to propagate resulting in poor ignition or again act as a diluent. For example, ettringite decomposes at less than 70° C. and about one third of the decomposition product is liquid water, and provides no cooling or temperature modulation benefits at many combustion temperatures across a wider range from as low as about 260° C. (500° F.) where magnesium carbonate is ineffective to 538° C. (1000° F.), which includes much of the temperature range where combustion processes occur while.

BRIEF DESCRIPTION

According to some embodiments of this disclosure, a combustible aerosol composition comprises an oxidizer comprising potassium bromate, a fuel comprising potassium cyanurate, and a hydrated mineral composition comprising hydromagnesite.

In some embodiments, a method of producing an aerosol comprises combusting a mixture comprising an oxidizer comprising potassium bromate, a fuel comprising potassium cyanurate, and a hydrated mineral composition comprising hydromagnesite.

In some embodiments, an aerosol dispensing device comprises a housing, a combustion chamber having disposed therein a composition comprising an oxidizer comprising potassium bromate, a fuel comprising potassium cyanurate, and a hydrated mineral composition comprising hydromagnesite, an igniter, and an opening for dispensing aerosol produced by the combustion of the composition.

BRIEF DESCRIPTION OF THE DRAWING

Subject matter of this disclosure is particularly pointed out and distinctly claimed in the claims at the conclusion of the specification. The foregoing and other features and advantages of the invention are apparent from the following detailed description taken in conjunction with the accompanying FIGURE, in which the FIGURE is a schematic depiction of an aerosol discharge device.

DETAILED DESCRIPTION

As used herein, the combustible aerosol-generating composition may also be referred to as simply an aerosol composition or combustible aerosol composition, even though the aerosol is technically not generated until combustion takes place.

As mentioned above, the aerosol composition also comprises a hydrated mineral comprising hydromagnesite. Hydrated minerals are typically naturally occurring minerals or minerals derived from naturally occurring minerals, containing water molecule(s) that are released upon heating. The water molecules may be chemically bound or they may be physically retained in the mineral material, and can be in the form of $H_2O$ molecules or hydroxide ions, even though the term "hydrated" is often used to refer to materials that are chemically combined with water molecules. In some embodiments, hydromagnesite can be the sole hydrated mineral (i.e., the composition comprises a hydrated mineral that consists of hydromagnesite). In some embodiments, the composition can include other hydrated minerals that do not have a significant impact on the performance of hydromagnesite in the composition (i.e., the composition comprises a hydrated mineral that consists essentially of hydromagnesite). In some embodiments, the composition comprises hydromagnesite and other hydrated minerals without restriction (i.e., the composition comprises a hydrated mineral oxidizer that comprises hydromagnesite). In some embodiments, the composition comprises hydrated mineral in an amount ranging from a minimum of greater than 0 wt. %, more specifically greater than or equal to 1.0 wt. %, and even more specifically greater than or equal to 3.0 wt. %, to a maximum of 10.0 wt. %, more specifically 8.0 wt. %, and even more specifically 4.0 wt. %, based on the total amount of the aerosol composition. The above minimum and maximum values can be independently combined to disclose a number of different ranges. In some embodiments, the above minimum and maximum values can be applied to hydromagnesite as the sole hydrated mineral. In some embodiments, the above minimum and maximum values can be applied to compositions comprising hydromagnesite and one or more other hydrated minerals.

In some embodiments, if other hydrated minerals are present, they can be selected from hydrated minerals having a dehydration decomposition temperature greater than 200° C. As used herein, a dehydration decomposition temperature is a temperature or temperatures at which a mineral endothermically releases water molecules, which may or may not be chemically bound with other elements in the mineral. Examples of hydrated minerals include those represented by the formula $(M^2)_k(M^3)_m(X^2)_n(X^3)_oY_p$, where $M^2$ is selected from a Group IA atom, Group IIA atom, Group IIIA atom, $M^3$ is selected from a Group IIA atom, Group IIIA, and a transition metal atom, $X^2$ is a hydroxyl anion, $X^3$ is a carbonate anion, Y represents ·(H2O), k, m, n, o, and p are each zero or each independently positive numbers, with the proviso that k and m cannot both be zero and that n and p cannot both be zero, and the values of k, m, n, o, and p are such that they balance the charges of $M^2$, $M^3$, $X^2$, and $X^3$. In some embodiments, $M^2$ is a Group IA atom comprising lithium, sodium, or potassium. In some embodiments, $M^2$ is a Group IIA atom comprising strontium, calcium, or magnesium. In some embodiments, $M^2$ is a Group IIIA metal cation such as aluminum ($Al^{+3}$). In a more specific embodiment, $M^2$ is magnesium. In an even more specific embodiment, $M^2$ is magnesium. In some embodiments, M3 is a Group IIA atom comprising strontium, calcium, or magnesium. In some embodiments, $M^3$ is a Group IIIA metal cation such as aluminum ($Al^{+3}$), and a transition metal cation such as iron ($Fe^{+3}$). In any case $M^2$ and $M^3$ will not be the same element. Various anions can be used for $X^2$ in the above formula, including but not limited to carbonate, and sulfate anions. Carbonate ions upon decomposition provide the additional benefit of releasing oxygen-diluting $CO_2$ in the aerosol combustion gases to further enhance fire suppression and facilitates the aerosolization of fire suppressants such as potassium bromide.

In some embodiments where other hydrated minerals are present, the hydrated mineral comprises 90 wt. % to less than 100 wt. % hydromagnesite and greater than 0 wt. % to 10 wt. % of another hydrated mineral(s), based on the total weight of hydrated minerals. In some embodiments, the hydrated mineral comprises 90-99 wt. % hydromagnesite and 1-10 wt. % of another hydrated mineral(s), based on the total weight of hydrated minerals. In some embodiments, the hydrated mineral comprises 97-99 wt. % hydromagnesite and 1-3 wt. % of another hydrated mineral(s), based on the total weight of hydrated mineral. In some embodiments, the addition of other hydrated minerals to hydromagnesite can augment the dehydration process by providing a relatively more continuous endothermic effect over the ignition temperature range. For example, hydromagnesite has endothermic absorptions occurring in the temperature regions of 309° C., 446° C., and 554° C. With the addition of, for example, dypingite, the endothermic absorptions occur in the regions of 260° C., 309° C., 420° C., 446° C., 512° C., and 554° C., thereby providing a more continuous endothermic process through the ignition temperature range resulting in a more continuous and complete combustion.

Examples of specific additional hydrated minerals include, but are not limited to, dypingite, hydrotalcite, giorgiosite, protomagnesite, artinite, $Al(OH)_3$, and $Mg(OH)_2$. In some embodiments, the additional hydrated minerals are selected from dypingite or hydrotalcite, or mixtures thereof. The additional minerals can be chosen to absorb energy (by release and vaporization of water from the hydrated salt structure) throughout the range of combustion temperatures, which can range from about 250° C. to about 600° C. For example, hydromagnesite demonstrates endothermic absorption of heat throughout the range of 300° C. through 560° C., with significant heat absorption occurring at 309° C., 446° C., and 554° C., with only a very small heat energy release at 516° C. In comparison, dypingite has major endothermic absorption of heat throughout the range of about 250° C. through 525° C., with significant heat absorption occurring at about 260° C., 420° C. and 514° C., with only a very small heat energy release at 495° C. Hydrotalcite has two major endothermic absorptions of heat at 250° C. and 405° C. Other hydrated minerals can include magnesium hydroxide (e.g., which decomposes to MgO and $H_2O$) having one major endothermic absorption at 409° C., and aluminum hydroxide having endothermic absorption at 234° C. and 311° C. etc., which can provide an effective complement to hydromagnesite. There are many other hydrated minerals that can be potentially used, which have similar or even higher order of hydration such as giorgiosite ($5MgO.4CO_2.7H_2O$), protomagnesite ($5MgO.4CO_2.7H_2O$), sodium carbonate decahydrate ($Na_2.4CO_3.10H_2O$), etc. Some of these materials may have issues such as lack of thermal stability at lower temperatures, poor shelf life, high price or limited commercial availability, chemically incompatibility, or redundant dehydration temperatures relative to hydromagnesite, but can nevertheless be useful depending on the particular application or operating environment.

As mentioned above, the aerosol composition also comprises an oxidizer comprising potassium bromate. In some embodiments, potassium bromate can be the sole oxidizer (i.e., the composition comprises an oxidizer that consists of potassium bromate). In some embodiments, the composition can include other oxidizers that do not have a significant impact on the performance of potassium bromate in the composition (i.e., the composition comprises an oxidizer that consists essentially of potassium bromate). In some embodiments, the composition comprises potassium bromate and other oxidizers without restriction (i.e., the composition comprises an oxidizer that comprises potassium bromate). In some embodiments, if other oxidizers are present, they can be selected from the formula $M^1(XO_y)_z$, wherein $M^1$ is selected from a Group IA atom, a Group IIA atom, and a Group IIIA atom, X is selected from the group consisting of Cl, Br and I, y is 1-4, and z is 1-3. In some embodiments, $M^1$ is a Group IA atom comprising lithium, sodium, or potassium. In some embodiments, $M^1$ is a Group IIA atom comprising strontium or magnesium. In some embodiments, $M^1$ is a Group IIIA metal such as aluminum. In more specific embodiments, $M^1$ is sodium or potassium. In an even more specific embodiment, $M^1$ is potassium. $XO_y$ can be a perhalate wherein y is 4; a halate wherein y is 3; or a halite or perhalate wherein x is 2. Examples of $XO_y$ include chlorates, bromates, iodates, perchlorates, periodates, chlorites, or mixtures thereof. In some embodiments, $XO_y$ is a bromate. In some embodiments, the oxidizer comprises from 50-100 wt. % potassium bromate and from 0-50 wt. % of other oxidizers, based on the total weight of oxidizer. In some embodiments, the oxidizer comprises from 20-80 wt. % potassium bromate and from 80-20 wt. % of other oxidizers, based on the total weight of oxidizer.

Examples of other oxidizers that can be used in combination with potassium bromate used in the aerosol compositions include lithium nitrate, sodium nitrate, potassium nitrate, aluminum nitrate, lithium chlorate, sodium chlorate, potassium chlorate, lithium bromate, sodium bromate, lithium iodate, sodium iodate, potassium iodate, aluminum iodate, lithium perchlorate, sodium perchlorate, potassium perchlorate, aluminum perchlorate, lithium periodate, sodium periodate, potassium periodate, aluminum periodate, lithium chlorite, sodium chlorite, potassium chlorite, aluminum chlorite, lithium bromite, sodium bromite, or mixtures thereof. Mixtures of oxidizers can be used to control the rate of burning. For example, potassium nitrate or sodium nitrate may be substituted for a portion of potassium bromate to decrease the rate of burning, as well as cost. In some embodiments, a suppressive halide salt, such as a Group IA, Group IIA or a Group IIIA halide salt, may be added to the composition, which salt can vaporize and recondense in the cooler regions of the reaction, thus increasing the suppressive power of the aerosol and decreasing the composition burning temperature and rate. Typically, the suppressive halide salt is present between about 0.1 to about 20 weight percent, more specifically between about 1 to about 15 weight percent. In another embodiment, the suppressive halide salt is present between about 1 to about 10 weight percent.

In some embodiments, the oxidizer can be present in an amount ranging from a minimum of 40 wt. %, more specifically 54 wt. %, and even more specifically 60 wt. %, to a maximum of 87 wt. %, more specifically 78 wt. %, and even more specifically 74 wt. %, based on the total amount of the aerosol composition. The above minimum and maximum values can be independently combined to disclose a number of different ranges. In some embodiments, the above minimum and maximum values can be applied to potassium bromate as the sole oxidizer. In some embodiments, the above minimum and maximum values can be applied to compositions comprising potassium bromate and one or more other oxidizers.

As mentioned above, the aerosol composition also comprises a fuel comprising potassium cyanurate. In some embodiments, potassium cyanurate can be the sole fuel (i.e., the composition comprises a fuel that consists of potassium cyanurate). In some embodiments, the composition can include other fuels that do not have a significant impact on the performance of potassium cyanurate in the composition (i.e., the composition comprises a fuel that consists essentially of potassium cyanurate). In some embodiments, the composition comprises potassium cyanurate and other fuels without restriction (i.e., the composition comprises a fuel that comprises potassium cyanurate). In some embodiments, if other fuels are present, they can be selected from melamine cyanurate, salts of cyanuric acid, other salts of isocyanuric acid, barbituric acid, hydroxyacetic acid, and mixtures thereof. Other fuel components like carbon black can also be included. The fuel component may also be a salt of other organic acids, including salts of hydroxy alkanedioic acids of a $C_{3-7}$ alkane, e.g., tartaric acid. Organic salts used as fuel in the aerosol composition can be Group IA or Group IIA salts. Thus, examples of other organic salts use in the compositions of the present invention include, but are not limited to, lithium cyanurate, sodium cyanurate, magnesium cyanurate, lithium isocyanurate, sodium cyanurate, potassium cyanurate, magnesium cyanurate, lithium barbiturate, sodium barbiturate, potassium barbiturate, magnesium barbiturate, lithium hydroxyacetate, sodium hydroxyacetate, potassium hydroxyacetate, magnesium hydroxyacetate, lithium tartrate, sodium tartrate, potassium tartrate, magnesium tartrate, or mixtures thereof. In some more specific embodiments, other organic salts can comprise magnesium cyanurate, potassium tartrate, magnesium tartrate, or mixtures thereof.

In some embodiments, the fuel can be present in an amount ranging from a minimum of 10 wt. %, more specifically 19 wt. %, and even more specifically 25 wt. %, to a maximum of 50 wt. %, more specifically 39 wt. %, and even more specifically 33 wt. %, based on the total amount of the aerosol composition. The above minimum and maximum values can be independently combined to disclose a number of different ranges. In some embodiments, the above minimum and maximum values can be applied to potassium cyanurate as the sole fuel. In some embodiments, the above minimum and maximum values can be applied to compositions comprising potassium cyanurate and one or more other fuels.

The aerosol compositions of the invention may further include a binder. The binder systems encompassed by the present invention should be chemically stable at storage temperatures, so that no reaction between the inorganic halogen component and the binder system will occur prior to use. Thus, the binder chosen for the binder system may include any such resin having a low flame temperature and heat of formation. The binder can in some cases also function as a fuel component, and some fuels (e.g., melamine) can become part of the binder by reacting into the binder matrix during cure.

Suitable binders include, but are not limited to, silicates, including alkali silicates, cellulose derivatives, cellulose ethers, alginic binders, gums, gels, pectins, starches, polyvinyl compounds or mixtures thereof. Examples of binders include, but are not limited to, hydrolyzed ethyl silicate; sodium silicate; potassium silicate; plasticized polyvinyl alcohol; polyvinyl butyral; polyvinyl acetate; cellulose derivatives, such as nitro cellulose, hydroxyethylethyl cellulose, hydroxypropyl cellulose, hydroxymethylethyl cellulose, sodium carboxymethyl cellulose, methyl cellulose, hydroxyethyl cellulose; hydroxypropyl cellulose, glycerine, polyvinyl pyrrolidone, ammonium alginate; sodium alginate; potassium alginate; magnesium alginate; triethanolamine alginate; propylene glycol alginate; gum Arabic; gum ghatti; gum tragacanth; Karaya gum; locust bean gum; acacia gum; guar gum; quince see gum; xanthan gum; agar; agarose; caragenneans; fucoidan; furecelleran or mixtures thereof. Other binders include, but are not limited to, carboxy-terminated polybutadiene (CTPB), polyethylene glycol (PEG), polypropylene glycol (PPG), hydroxy-terminated polybutadiene (HTPB), polybutadiene acrylonitrile (PBAN), polybutadiene acrylic acid (PBAA), butacene (HTPB iron adduct), glycidyl azide polymer (GAP), polyglycol adipate (PGA), or other thermoplastic polymers such as but not limited to polystyrene, polycarbonate, and polyvinylchloride, as well as compatible mixtures of any of the foregoing thereof.

The binder, when used, can be present in an amount from about 0.5 weight percent to about 20 weight percent of the composition. In another embodiment, the binder is present in an amount from about 1 weight percent to about 15 weight percent of the composition. In some embodiments, the binder is present in an amount from about 2 weight percent to about 10 weight percent of the composition. Polyols known to one of ordinary skill in the art may be added in addition to the binder to plasticize the binder material and increase the dry strength of the product. Examples of such polyols include, but are not limited glycerol and glycols, such as propylene glycol or polyethylene glycol. Typically, the polyols are present in an amount from about 0.5 weight percent to about 20 weight percent of the composition. In another embodiment, the polyol is present in an amount from about 4 weight percent to about 15 weight percent of the composition. In yet another embodiment, the polyol is present in an amount from about 8 weight percent to about 12 weight percent of the composition. In some embodiments, the polyol is present in an amount from about 2 weight percent to about 6 weight percent.

In some embodiments, the binder system is organic in nature and includes at least a binder or binder resin and a plasticizer, such as those described in U.S. Pat. No. 6,019,177, the entirety of which is incorporated herein by reference. The binder system can be in a solid form at a temperature below 100° C. The binder resin may include at least one of a curable binder, melt cast binder, or solvated binder, or a mixture thereof. The binder system may also include one or more of a curing or bonding agent, an antioxidant, an opacifier, or a halogen scavenger such as lithium carbonate. Curing agents suitable for use with the invention may include hexamethylene diisocyanate (HMDI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylene diisocyanate (MXDI), other diisocyanates, triisocyanates, higher isocyanates than the triisocyanates, polyfunctional isocyanates, or a mixture thereof. The amount of the curing agent needed is generally determined by the desired stoichiometry between the curable binder and the curing agent. The curing agent is typically present in an amount of up to about 5 percent. However, if a curable binder is used, the curing agent is present from about 0.5 percent to about 5 percent.

Other additives can be included as well, as known in the art, including but not limited to cure catalysts (e.g., butyl tin dilaurate, a metal acetylacetonate), antioxidants (e.g., 2,2'-bis(4-methyl-6-t-butylphenol)), corrosion inhibitors, extrusion lubricants, or solid coolants. An opacifier such as carbon black can aid in providing uniform heat transfer and reducing possible areas of select heat build-up. It also functions as a UV obscurant to help mitigate radiant UV transmission emitting from the burn front into the unburned composition. Exemplary levels for opacifiers can range from 0.01 wt. % to 2 wt. % based on the total solids of the combustible composition.

The combustible aerosol-generating composition can be prepared by blending the above-described components, i.e., oxidizer, fuel, hydrated mineral, optional binder or components thereof (e.g., polyfunctional resin and polyfunctional curing agent), and any additional or optional components in a mixing vessel. During the working time of the composition, the mixture can be molded into a desired shape or extruded and pelletized. The presence in the composition of materials that will release moisture at relatively low temperatures, e.g., below 180° C. can cause the composition to burn poorly, inconsistent and or not function at all, particularly at temperature extremes (−40° F. and +160° F.). Accordingly, in some embodiments, such materials that can retain water and release it at temperatures below 180° C. (e.g., potassium cyanurate and bromate) are dried such as by heating to temperatures of 180° C. In some embodiments, particle sizes of the various ingredients before blending are selected to help contribute to beneficial burn rate profiles and other characteristics. Exemplary particle sizes for the oxidizer (e.g., $KBrO_3$) and fuel (e.g., potassium cyanurate) can range from 1 μm to 100 μm, more specifically from 1 μm to 50 μm, and even more specifically from 1 μm to 30 μm. Exemplary particle sizes for the hydrated salts (e.g. hydromagnesite) can range be less than 100 μm, more specifically less than 40 μm, and even more specifically less than 10 μm. After cure the composition is complete, the solid combustible aerosol-generating composition can be fitted into an aerosol-generating module. An exemplary aerosol module is schematically depicted in the FIGURE, where aerosol module 10 has a housing or vessel 12 with a solid aerosol-generating composition 14 therein. Upon activation of combustion by ignition device 16 (e.g., an electronic ignition device), combustion of the aerosol composition 14 produces combustion gases and particulates 18 that are exhausted as an aerosol through opening 19.

The aerosol fire suppression compositions can be used for fire suppression, as mentioned above, and also for other uses, including but not limited to smoke grenades, colored signal devices, smoke tracers, agent dispersal compositions, and air current tracer devices of low incendiary potential. The dense, opaque, nontoxic smoke produced, which is transparent to infrared vision devices, provides for utility in crowd control or hostage situations encountered by law enforcement. In addition, the pyrotechnic aerosol fire suppression compositions may also be used as an expulsion charge for items, such as infrared flares and other types of flares. The low reaction temperatures and lack of flash can aid in concealing the combustion source from observation. Further, the compositions of the present invention may be used in finely granulated form to generate gas to fill air bags, particularly where low temperatures are required to avoid damage to the air bag itself.

The invention is further described in the following Examples set forth below.

EXAMPLE 1

About 58.0 grams of 98%+ of powdered potassium bromate (Spectrum Chemical Mfg. Corporation) are prepared by reducing particle size between 1μ and 30μ using a ball jar mill/burundum apparatus or equivalent. A homogenous combination is prepared of about 25.0 grams of anhydrous powdered (between 1μ and 30μ as described above), potassium cyanurate (manufactured using methods described in U.S. Pat. No. 7,728,132, U.S. Pat. No. 8,067,587 or though commercial source), about 3.7 grams of powdered (under 10μ) hydromagnesite (Minelco Limited), about 0.3 grams of powdered (under 10μ) hydrotalcite (Sigma-Aldrich Co.), and about 1.5 grams of carbon black (Monarch 1400, Cabot Corporation or equivalent). The powdered potassium bromate is added to the above potassium cyanurate/hydromagnesite/carbon black combination and mixed until homogenous. The resultant homogenous mixture can be used directly as is or compressed into a vessel for use as a combustible aerosol.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A combustible aerosol composition, comprising
an oxidizer comprising potassium bromate;
a fuel comprising potassium cyanurate; and
a hydrated mineral comprising 90-99 wt. % hydromagnesite and 1-10 wt. % of one or more other hydrated minerals having a dehydration decomposition temperature in the range of 200° C. to 600° C.

2. The composition of claim 1, wherein the one or more other hydrated minerals are according to the formula $(M^2)_k(M^3)_m(X^2)_n(X^3)_oY_p$, where $M^2$ is selected from a Group IA atom, Group IIA atom, Group IIIA atom, $M^3$ is selected from a Group IIA atom, Group IIIA, and a transition metal atom, $X^2$ is a hydroxyl anion, $X^3$ is a carbonate anion, Y represents $\cdot(H_2O)$, k, m, n, o, and p are each zero or each independently positive numbers, with the proviso that k and m cannot both be zero and that n and p cannot both be zero, and the values of k, m, n, o and p are such that they balance the charges of $M^2$, $M^3$, $X^2$, and $X^3$.

3. The composition of claim 1, wherein the one or more other hydrated minerals are selected from hydrotalcite, dypingite, brucite, gibbsite or mixtures thereof.

4. The composition of claim 1, wherein the hydrated mineral consists of hydromagnesite.

5. The composition of claim 1, further comprising potassium bromide.

6. The composition of claim 1, further comprising carbon black.

7. The composition of claim 1, comprising 55-75 wt. % potassium bromate, 12-36 wt. % potassium cyanurate, 1-10 wt. % hydromagnesite, and 0-10 wt. % one or more additional components selected from oxidizers, fuels, hydrated minerals, opacifiers, flame retardants, or other additives.

8. A combustible aerosol composition, comprising
an oxidizer comprising potassium bromate derived from potassium bromate particles having a particle size of 1-100 μm;
a fuel comprising potassium cyanurate derived from potassium cyanurate particles having a particle size of 1-100 μm; and
a hydrated mineral comprising hydromagnesite derived from hydromagnesite particles having a particle size of less than 100 μm.

9. The composition of claim 8, wherein the potassium bromate is derived from potassium bromate particles having a particle size of 1-50 μm, the potassium cyanurate is derived from potassium cyanurate particles having a particle size of 1-50 μm, and the hydromagnesite is derived from hydromagnesite particles having a particle size of less than 40 μm.

10. The composition of claim 8, wherein the potassium bromate is derived from potassium bromate particles having a particle size of 1-30 μm, the potassium cyanurate is derived from potassium cyanurate particles having a particle size of 1-30 μm, and the hydromagnesite is derived from hydromagnesite particles having a particle size of less than 10 μm.

11. A combustible aerosol composition, comprising
40-87 wt. % potassium bromate derived from potassium bromate particles having a particle size of 1-100 μm;
10-50 wt. % potassium cyanurate derived from potassium cyanurate particles having a particle size of 1-100 μm;
greater than 0 wt. % to 10 wt. % a hydrated mineral comprising hydromagnesite derived from hydromagnesite particles having a particle size of less than 100 μm; and
0-50 wt. % one or more additional components selected from oxidizers, fuels, hydrated minerals, opacifiers, flame retardants, or other additives.

12. The composition of claim 11, wherein the hydrated mineral comprises 90-99 wt. % hydromagnesite and 1-10 wt. % of one or more other hydrated minerals having a dehydration decomposition temperature in the range of 200° C. to 600° C.

13. The composition of claim 12, wherein the one or more other hydrated minerals are selected from hydrotalcite, dypingite, brucite, gibbsite, or mixtures thereof.

14. The composition of claim 11, comprising from greater than 0 wt. % to 20 wt. % potassium bromide.

15. The composition of claim 14, comprising from greater than 0 wt. % to 5 wt. % carbon black.

16. The composition of claim 11, comprising from greater than 0 wt. % to 5 wt. % carbon black.

17. A method of producing an aerosol, comprising combusting the composition of claim 1.

18. An aerosol dispensing device, comprising a housing, a combustion chamber, the composition of claim 1 disposed in the combustion chamber, an igniter, and an opening from the combustion chamber for dispensing aerosol produced by combustion of the composition of claim 1.

19. An aerosol dispensing device, comprising a housing, a combustion chamber, the composition of claim 11 disposed in the combustion chamber, an igniter, and an opening from the combustion chamber for dispensing aerosol produced by combustion of the composition of claim 11.

* * * * *